US011614238B2

(12) United States Patent
Lee

(10) Patent No.: US 11,614,238 B2
(45) Date of Patent: Mar. 28, 2023

(54) ELECTRIC COMPOSITE HEAT OVEN WITH SIGHT WINDOW FOR TRANSPARENT PLANAR HEATING ELEMENT

(71) Applicant: Ik-No Lee, Seoul (KR)

(72) Inventor: Ik-No Lee, Seoul (KR)

( * ) Notice: Subject to any disclaimer, the term of this patent is extended or adjusted under 35 U.S.C. 154(b) by 4 days.

(21) Appl. No.: 17/260,725

(22) PCT Filed: Jul. 16, 2019

(86) PCT No.: PCT/KR2019/008768

§ 371 (c)(1),
(2) Date: Jan. 15, 2021

(87) PCT Pub. No.: WO2020/022689

PCT Pub. Date: Jan. 30, 2020

(65) Prior Publication Data

US 2021/0262668 A1 Aug. 26, 2021

(30) Foreign Application Priority Data

Jul. 25, 2018 (KR) ..... 10-2018-0086677

(51) Int. Cl.
*F24C 7/06* (2006.01)
*F24C 7/08* (2006.01)
*F24C 15/04* (2006.01)

(52) U.S. Cl.
CPC ..... *F24C 7/067* (2013.01); *F24C 7/085* (2013.01); *F24C 15/04* (2013.01)

(58) Field of Classification Search
USPC ..... 219/400
See application file for complete search history.

(56) References Cited

U.S. PATENT DOCUMENTS

2005/0237528 A1* 10/2005 Oldham ..... B01L 3/5027 356/414
2008/0213447 A1* 9/2008 Payen ..... A47J 37/0641 219/385

FOREIGN PATENT DOCUMENTS

CN 103156532 * 6/2013
CN 204970952 U 1/2016
JP 2000-291963 A 10/2000
JP 2000291963 A * 10/2000
(Continued)

OTHER PUBLICATIONS

International Search Report from corresponding PCT Application No. PCT/KR2019/008768, dated Oct. 25, 2019.

*Primary Examiner* — Tu B Hoang
*Assistant Examiner* — Vy T Nguyen
(74) *Attorney, Agent, or Firm* — Harness, Dickey & Pierce, P.L.C.

(57) ABSTRACT

An electric composite heat oven provided with a sight window of a transparent planar heating element is provided. Since the electric composite heat oven has a structure in which a heater heating element is installed, being lower than the upper end of a cooking container, on the front and rear sidewalls of a cooking chamber of an enclosure and a transparent planar heating element is installed over an opening of the cooking chamber of the enclosure, radiant heat may actively control various disturbances that occur during cooking depending on a place where the oven is installed and a change in temperature, whereby there is an effect of providing the optimum heat power depending on a cooking material and also shortening cooking time.

5 Claims, 4 Drawing Sheets

(56) References Cited

FOREIGN PATENT DOCUMENTS

| | | | | |
|---|---|---|---|---|
| JP | 5799424 | B2 | | 10/2015 |
| KR | 20-1997-0024607 | U | | 6/1997 |
| KR | 20050061708 | | * | 6/2005 |
| KR | 10-0589768 | B1 | | 6/2006 |
| KR | 10-2011-0047511 | A | | 5/2011 |
| KR | 10-2016-0011993 | A | | 2/2016 |
| KR | 10-2019-0016436 | A | | 2/2019 |

* cited by examiner

ELECTRIC COMPOSITE HEAT OVEN WITH SIGHT WINDOW FOR TRANSPARENT PLANAR HEATING ELEMENT

CROSS-REFERENCE TO RELATED APPLICATIONS

This application is a national phase application of PCT Application No. PCT/KR2019/008768, filed on Jul. 16, 2019, which claims benefit of and priority to Korean Patent Application 10-2018-0086677, filed on Jul. 25, 2018. The entire disclosure of the applications identified in this paragraph are incorporated herein by references.

TECHNICAL FIELD

The present invention relates to an electric composite heat oven provided with a sight window of a transparent planar heating element and more particularly, to an electric composite heat oven provided with a sight window of a transparent planar heating element. The electric composite heat oven is capable of actively controlling disturbances by controlling the intensity of convective heat and radiant heat by means of the transparent door planar heating element and heater heating elements.

BACKGROUND

In general, an oven for cooking is mostly equipped with a heater (i.e., heater that generates convective heat) inside an enclosure thereof. Radiant heat is generated through preheating by the inherent characteristics (i.e., emissivity, heat capacity, and radiant area depending on a material of the enclosure) of an oven's enclosure.

Meanwhile, as for a sight window of an oven, a cooking material should be radiated with the heat generated from inside the oven, but at this time, when a sudden change occurs in the amount of the radiant heat emitting from the oven to the outside, the sight window is unable to respond to the change accordingly.

A ratio of convective heat and radiant heat has a great importance in cooking. In general, a cooking material should be provided with different thermal power (i.e., each different heat amount of convective heat and radiant heat) according to the type, size, and quantity of the cooking material. In addition, the ratio of convective heat and radiant heat may change a caramelization reaction and a Maillard reaction on the surface of the cooking material, a moisture and a fat content in the core of the cooking material, etc.

In the past, radiant heat was generated by preheating of the oven enclosure with a convection heater, but recently, some attempts have been made to generate heat by a radiation heater and a convection heater installed in the oven enclosure.

However, these attempts are insufficient to control various disturbances that can occur during cooking. In particular, it is almost impossible to control the disturbances that can occur from the outside.

In addition, most of the sight windows of ovens are equipped with glass. Glass has an emissivity of about 0.9, and is a material that absorbs and emits radiant heat very well.

When glass sight windows are exposed to the outside, the radiant heat generated from the inside of an oven radiates both inside and outside of the oven according to the heat gradient. Additionally, an amount of the radiant heat outside of the oven varies depending on conditions of the place where an oven is installed.

That is, Stefan-Boltzmann's law of radiant energy is defined as: $E=\sigma\varepsilon A T^4$ (where, $\sigma$: Stefan-Boltzmann constant, $\varepsilon$: emissivity, A: heat transfer area, T: absolute temperature)

Stefan-Boltzmann's law of radiant energy described above may more clearly explain disturbances due to the place where an oven is installed.

Most places where an oven is installed have a considerably larger area than that of the sight window of the oven with the emissivity (i.e., absorption rate) varying depending on materials in the place where an oven is installed. However, most of the places are equipped with a material of relatively high emissivity (i.e., absorption rate).

For example, an oven may be installed in a place where the temperature of an external heat absorbing surface (i.e., wall, ceiling, etc.) is 20 degrees and an area of the place may be 100 times larger than that of a sight window of the oven. When the temperature of the external heat absorbing surface is decreased to 10 degrees due to a change in temperature, results of cooking may be undesirable based on Stefan-Boltzmann's law of radiant energy described above.

In addition, although the absolute temperature slightly decreased from 293 degrees Celsius to 283 degrees Celsius, the total outflow amount of radiant energy increases more than 10 times depending on the increased heat energy gradient.

Accordingly, glass of the sight window cools down and the heat gradient between the glass and the cooking material is reduced, so that the radiant heat applied to the cooking material is also reduced.

In addition, since the radiant heat outflow from the sight window of the oven fluctuates even with a location change in the oven installed place, it is necessary to control the temperature of the sight window for optimal cooking.

Therefore, in order to control the oven accurately, an active temperature control of the sight window serves as an important factor.

SUMMARY

Technical Problem

The present invention is proposed to solve previously existing problems by providing an electric composite heat oven provided with a sight window of a transparent planar heating element, wherein cooking time is shortened by actively controlling temperature of the sight window, optimum thermal power is provided depending on a cooking material, and a cleaning problem may be easily solved by employing a detachable cooking container.

Technical Solution

According to an exemplary embodiment of the present invention for solving the above technical problems, an electric composite heat oven provided with a sight window of a transparent planar heating element includes: an enclosure having a cooking chamber; a door for opening or closing an opening of the enclosure; a cooking-material fixing means for fixing cooking material inside the enclosure; heater heating elements installed on inner sidewalls of the enclosure to generate convective heat; and the transparent planar heating element installed in the door to generate radiant heat.

In another exemplary embodiment of the present invention, the transparent planar heating element may be combined in an inner space of the door, and an exterior of the door may be supported by a door support means to open or close an upper opening of the cooking chamber, the door support means being pivotably hinged on a side of an upper end of the enclosure.

In another exemplary embodiment of the present invention, the cooking-material fixing means may be configured to include a cooking container formed lower than a height of the cooking chamber so that heat generated by the heater heating elements passes through an upper opening of the cooking container; and a grill mounted on the cooking container.

In another exemplary embodiment of the present invention, the cooking container may be configured to include: bent pieces protruding inward by cutting from a pair of left and right handle holes so that the grill is mounted at a predetermined height of left and right sidewalls of the cooking container; and a plurality of heat circulation holes arranged at regular intervals in each lower part of front and rear sidewalls of the cooking container.

In another exemplary embodiment of the present invention, the heater heating elements may be respectively installed to be horizontal with respect to a front sidewall and a rear sidewall of the cooking chamber at a predetermined height lower than a height of an upper end of the cooking container.

Advantageous Effects

In the electric composite heat oven provided with the sight window of the transparent planar heating element of the present invention, since the oven has a structure in which a pair of heater heating elements is installed, being lower than an upper end of the cooking container, on the front and rear sidewalls of the cooking chamber of the enclosure and the transparent planar heating element is installed over the opening of the cooking chamber of the enclosure, radiant heat may actively control various disturbances that occur during cooking depending on the oven installed place and the a change in temperature, whereby there is an effect of providing the optimum heat power depending on a cooking material and also shortening cooking time.

In addition, in the electric composite heat oven provided with the sight window of the transparent planar heating element of the present invention, since the electric composite heat oven has a structure in which the cooking container is able to be moved in and out of the cooking chamber through an open upper opening of the cooking chamber, meat juice, food debris, and etc. flowing down from the cooking material during cooking is able to be received, whereby there is an advantage in that contamination of the interior of the enclosure may be minimized and the cooking container may be cleaned by being separated from the enclosure.

DETAILED DESCRIPTION

Figure 1:
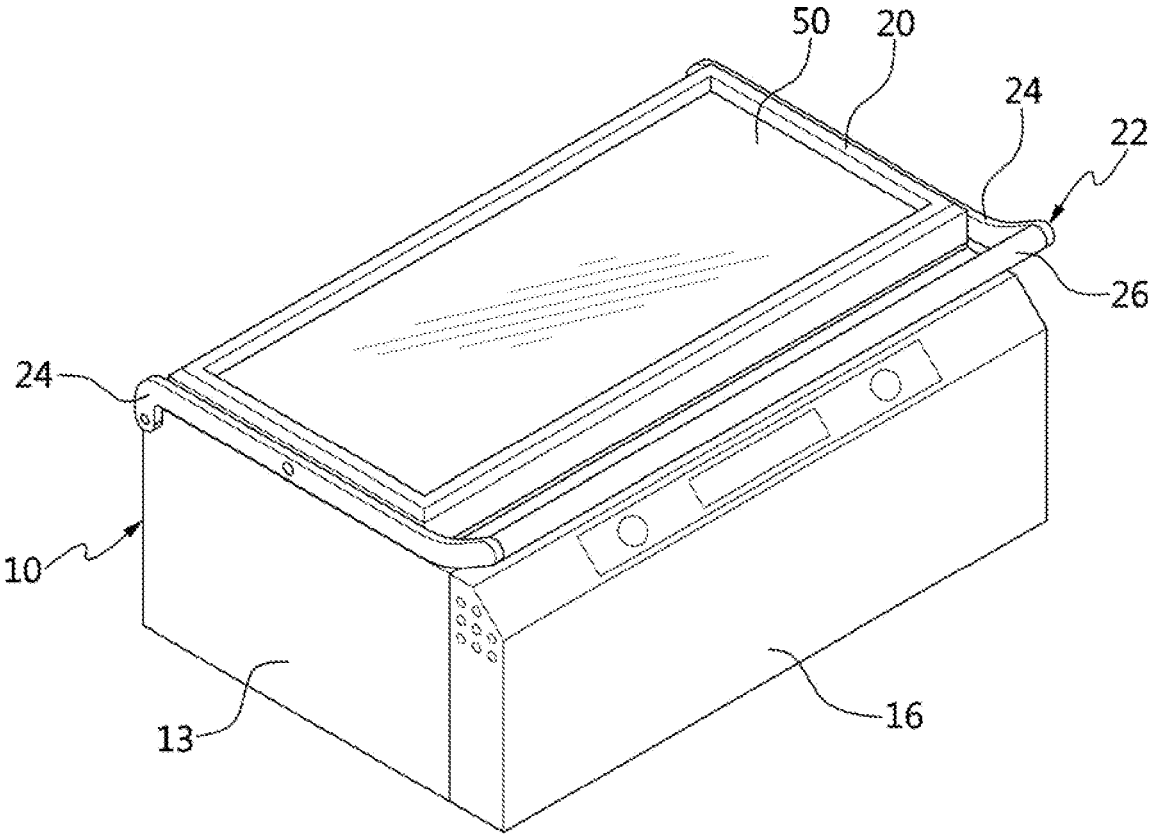
FIG. 1 is a perspective view showing a closed state of a door of an electric composite heat oven according to the present invention.

In order to fully understand the present invention, a preferred exemplary embodiment of the present invention will be described with reference to the accompanying drawings. It should be understood that the exemplary embodiment of the present invention may be changed to a variety of embodiments and the scope and spirit of the present invention are not limited to the exemplary embodiment described hereinafter. The present exemplary embodiment is provided to more completely explain the present invention to those skilled in the art. Accordingly, the shapes of elements in the drawings may be exaggerated to emphasize a clearer description. It should be noted that the same configuration in each drawing may be indicated by the same reference numeral. Detailed descriptions of known functions and configurations herein that are determined to unnecessarily obscure the subject matter of the present invention will be omitted.

Hereinafter, an exemplary embodiment of the present invention will be described in detail with reference to the accompanying drawings.

Figure 2:
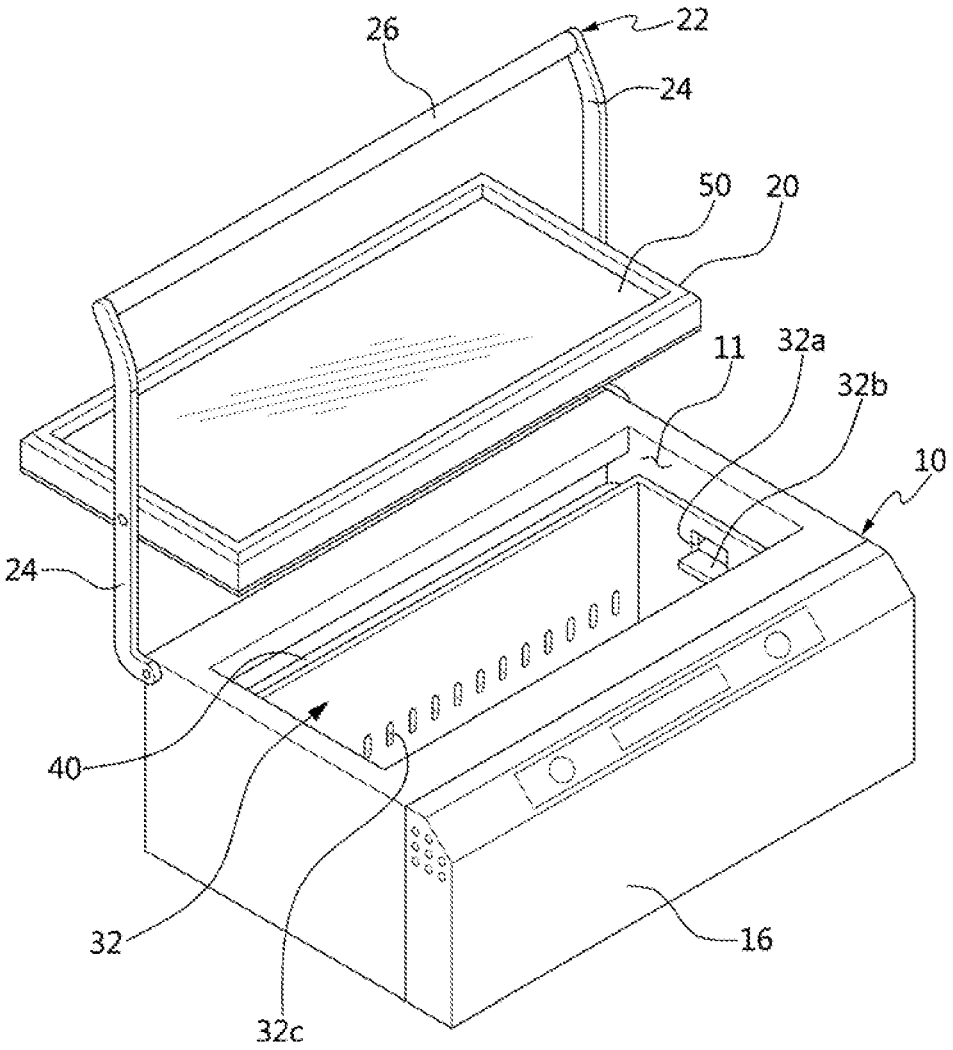
FIG. 2 is a perspective view showing an opened state of the door of the electric composite heat oven according to the present invention.
Figure 3:
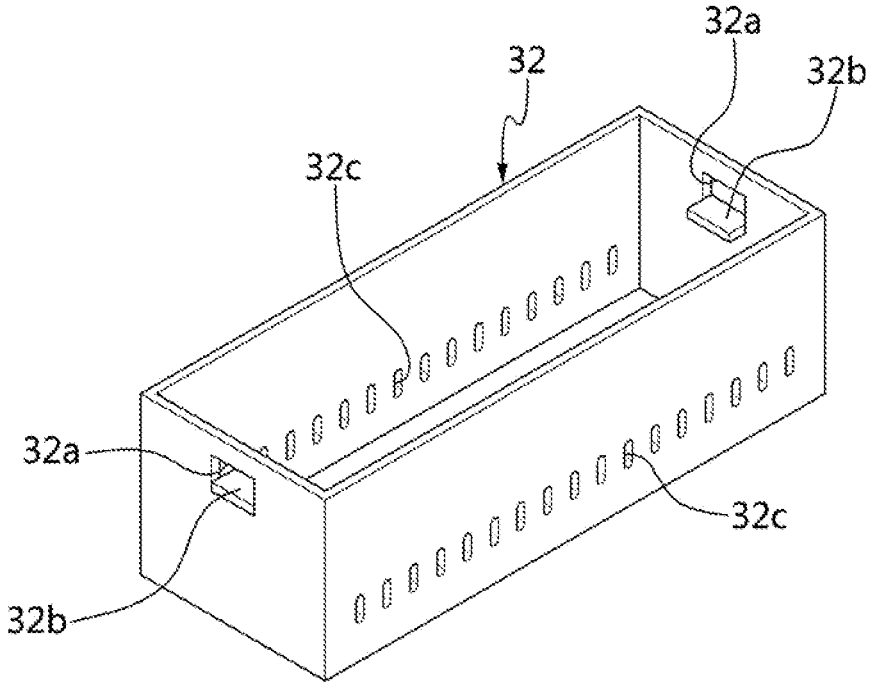
FIG. 3 is a perspective view showing a cooking container used in the electric composite heat oven according to the present invention.
Figure 4:
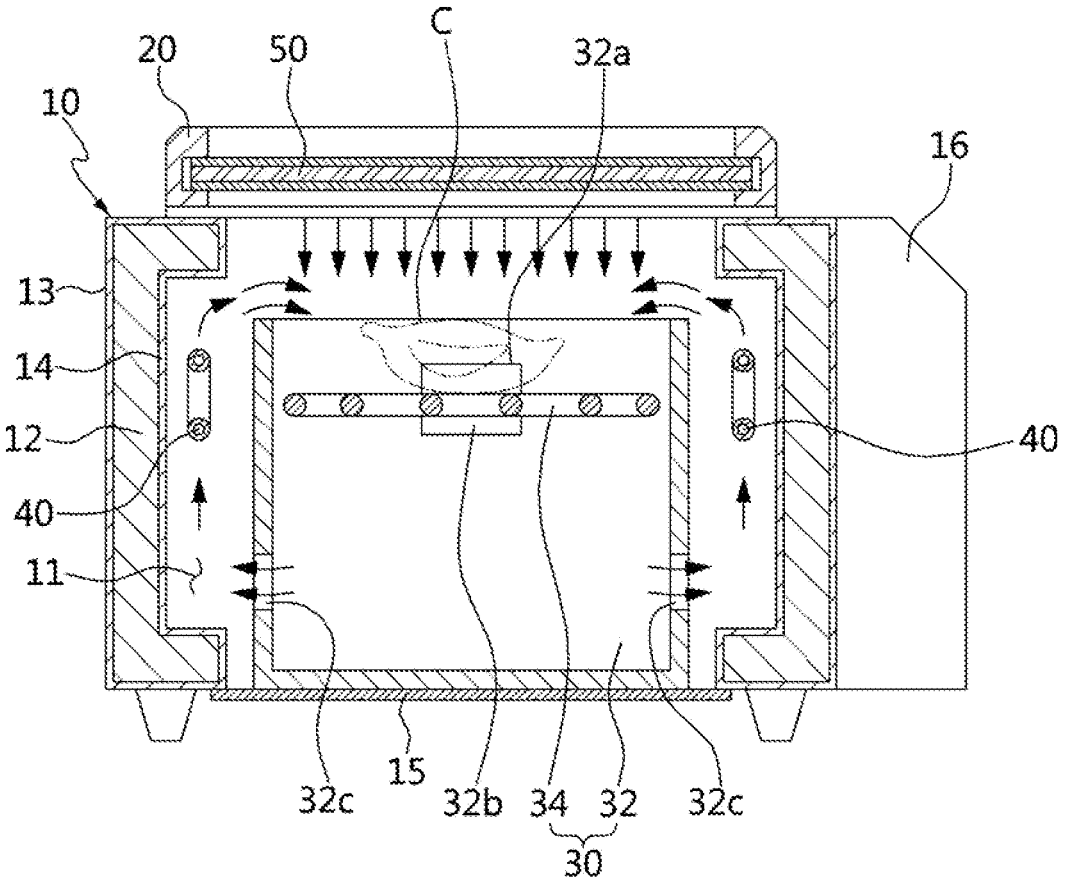
FIG. 4 is a longitudinal cross-sectional view showing the electric composite heat oven according to the present invention.

FIGS. 1 and 2 are perspective views showing a closed state and an opened state of a door of an electric composite heat oven according to the present invention, FIG. 3 is a perspective view showing a cooking container used in the electric composite heat oven according to the present invention, and FIG. 4 is a longitudinal cross-sectional view showing the electric composite heat oven according to the present invention.

Referring to FIGS. 1 to 4, in the electric composite heat oven provided with the sight window of the transparent planar heating element of the exemplary embodiment of the present invention, the electric composite heat oven includes: an enclosure 10 having a cooking chamber 11 with an open upper part thereof; a door 20 for opening and closing an opening of the enclosure 10; a cooking-material fixing means 30 for fixing a cooking material C inside the enclosure 10; a pair of heater heating elements 40 installed opposite each other on inner sidewalls of the enclosure 10 to generate convective heat at the same time; and a transparent planar heating element 50 installed in the door 20 to generate radiant heat.

That is, the enclosure 10 has a rectangular cylindrical shape, wherein the inner enclosure 14 and the outer enclosure 13 are coupled to face each other with an insulating material 12 interposed therebetween so as to form the cooking chamber 11 having the open upper opening thereof, wherein a bottom plate 15 is coupled to an outer bottom of the enclosure 10 where the inner enclosure 14 and the outer enclosure 13 contact each other, so as to close a lower opening of the enclosure 10, and a control box 16 is coupled to a front surface of the outer enclosure 13 to control the heater heating elements 40 and the transparent planar heating element 50.

The door 20 has a rectangular frame shape having an area thereof larger than an area of the upper opening of the cooking chamber 11, and the transparent planar heating element 50 is combined in an inner space of the door 20. In addition, an exterior of the door 20 is supported by a door support means 22 to open or close the upper opening of the cooking chamber 11, the door support means 22 being pivotably hinged on each side of an upper end of the enclosure 10.

In this case, the door support means 22 is configured to include: a pair of left and right rotating bars 24 having each first end thereof is pivotably hinged at the rear upper end of the left and right sides of the enclosure 10, and at the same time having each center of the left and right rotating bars 24 in the longitudinal direction is pivotably hinged with each center of the left and right sides of the door 20; and a handle 26 connecting each second end of the pair of left and right rotating bars 24.

The cooking-material fixing means 30 is configured to include: a cooking container 32 having a rectangular cylindrical shape formed lower than the height of the inner enclosure 14 so that the heat generated by each heater heating element 40 passes through the upper opening of the cooking container 32; and a grill 34 mounted on the cooking container 32.

In this case, the cooking container 32 is configured to include: bent pieces 32*b* protruding inward by cutting from a pair of left and right handle holes 32*a* so that the grill 34 is mounted horizontally at a predetermined height of the left and right sidewalls of the cooking container 32; and a plurality of heat circulation holes 32*c* arranged horizontally at regular intervals in each lower part of the front and rear sidewalls of the cooking container 32 so that the remaining heat after heating the cooking material C seated on the grill 34 inside the cooking container 32 is allowed to pass by the heater heating elements 40 to be circulated by natural convection.

The pair of heater heating elements 40 are formed in a U shape, and the heater heating elements 40 are respectively installed to be horizontally lain with respect to the front side wall and the rear sidewall of the cooking chamber 11 of the enclosure 10 at a predetermined height lower than the height of an upper end of the cooking container 32.

The transparent planar heating element 50 formed of a combination of glass and a planar heating element is combined by a square frame of the door 20, and while the door 20 is closed, the transparent planar heating element 50 provides a heating function for generating radiant heat in the cooking chamber 11 and a sight window function so as to allow a user to see the inside of the cooking chamber 11 at the same time.

In the electric composite heat oven provided with the sight window of the transparent planar heating element of the present invention configured as described above, since the oven has a structure in which the pair of heater heating elements 40 is installed, being lower than the upper end of the cooking container 32, on the front and rear sidewalls of the cooking chamber 11 of the enclosure 10, and the transparent planar heating element 50 is installed over the opening of the cooking chamber 11 of the enclosure 10, when operating the oven after the cooking material C is placed while the grill 34 is mounted on the bent pieces 32*b* inside the cooking container 32, the heater heating elements 40 and the transparent planar heating element 50 emit high-temperature convective heat and radiant heat respectively toward the cooking container 32 while generating heat at a preset temperature according to the programmed heating power control.

That is, the convective heat emitted from the pair of heater heating elements 40 flows upward by natural convection through a gap between the inner enclosure 14 and the cooking container 32 as shown in the arrow direction shown in FIG. 4, and at the same time, while flowing into the inside of the cooking container 32 through the upper opening of the cooking container 32, the convective heat merges with radiant heat to heat the cooking material C. The remaining heat after heating the cooking material C flows between the inner enclosure 14 and the cooking container 32 after passing through each of the plurality of heat circulation holes 32C formed on the lower part of the sidewall of the cooking container 32, and at the same time, is circulated to be heated again while passing by the heater heating elements 40.

Since such a composite heat oven method using convective heat of the heater heating elements 40 and the radiant heat of the transparent planar heating element 50 enables control of the intensity of convective and radiant heat during cooking, there is an advantage in that disturbances may be actively controlled, so as not to be constrained by a change in temperature depending on a place where the oven is installed.

That is, since the transparent planar heating element 50 has a structure in which glass and the planar heating element are combined with each other so as to simultaneously provide the heating function for generating radiant heat and the sight window function for allowing the user to see the inside of the cooking chamber 11, when the glass is exposed to the outside, much of the radiant heat generated from the inside of the oven may radiate to the outside where the external temperature is lower than the inside of the oven. However, since the heat lost in such a way is supplemented by the radiant heat generated by the transparent planar heating element 50, various disturbances generated during cooking may be actively controlled, whereby it is possible to provide optimal heat power depending on the cooking material and also shorten the cooking time.

Since the cooking container 32 is able to be moved in and out of the cooking chamber 11 through the open upper opening of the cooking chamber, meat juice or food debris flowing down from the cooking material during cooking is able to be received, whereby there is the advantage in that contamination of the interior of the enclosure may be minimized and the cooking container 32 may be cleaned by being separated from the enclosure 10, so as to maintain a clean state.

Meanwhile, the present invention is not limited to the above-described exemplary embodiment, but may be embodied with modifications and variations within the scope of the gist of the present invention. Further, the technical idea to which such modifications and variations are applied should also be regarded as falling within the scope of the following claims.

What is claimed is:

1. An electric heat oven comprising:

an enclosure having inner sidewalls defined a cooking chamber;

a door for opening or closing an opening of the enclosure;

a cooking-material fixing means for fixing cooking material inside the enclosure;

a heater formed in a U-shape and horizontally installed on the inner sidewalls of the enclosure to generate heat;

a transparent planar heating element installed in the door for forming a sight window, wherein the transparent planar heating element is configured to generate radiant heat; and a control box connected to a front outer surface of the enclosure to control the heater and the transparent planar heating element, wherein the cooking-material fixing means includes a cooking container formed lower than a height of the cooking chamber so that the heat generated by the heater passes through an upper opening of the cooking container, wherein at least one heat circulation hole is arranged in a lower part of sidewalls of the cooking container so that the generated heat is naturally circulated through the at least one heat circulation hole to be heated again while passing by the heater thereby forming convective heat, wherein the convective heat passing through the at least one heat circulation hole is heated again while passing by the heater and flowing upward through a gap between the enclosure and the cooking container before passing through the upper opening of the cooking container, and wherein the convective heat is used to supplement a heat lost of at least the radiant heat generated by the transparent planar heating element, thereby controlling various disturbances generated during cooking.

2. The electric composite heat oven of claim 1, wherein the transparent planar heating element is combined in an inner space of the door, and an exterior of the door is supported by a door support to open or close an upper opening of the cooking chamber, the door support being pivotably hinged on a side of an upper end of the enclosure.

3. The electric composite heat oven of claim 1, wherein the cooking-material fixing means is configured to include:

a grill mounted on the cooking container.

4. The electric composite heat oven of claim 3, wherein the cooking container is configured to include:

bent pieces protruding inward so that the grill is mounted at a predetermined height of sidewalls of the cooking container.

5. The electric composite heat oven of claim 3, wherein the heater is respectively installed to be horizontal with respect to a front sidewall and a rear sidewall of the cooking chamber at a predetermined height lower than a height of an upper end of the cooking container.

* * * * *